US006467529B2

(12) United States Patent
Kay

(10) Patent No.: US 6,467,529 B2
(45) Date of Patent: Oct. 22, 2002

(54) APPARATUS FOR REMOVAL OF SAND FROM METAL CASTINGS

(75) Inventor: John R. Kay, Niagara Falls (CA)

(73) Assignee: Can-Eng Furnaces, Ltd., Niagara Falls (CA)

( * ) Notice: Subject to any disclaimer, the term of this patent is extended or adjusted under 35 U.S.C. 154(b) by 0 days.

(21) Appl. No.: 09/785,733

(22) Filed: Feb. 16, 2001

(65) Prior Publication Data

US 2002/0112839 A1 Aug. 22, 2002

(51) Int. Cl.[7] ..... B22D 29/00

(52) U.S. Cl. ..... 164/131; 164/132; 164/5; 164/269; 164/234; 164/410; 164/345; 164/408

(58) Field of Search ..... 164/131, 132, 164/5, 269, 234, 410, 345, 408

(56) References Cited

U.S. PATENT DOCUMENTS 5,360,049 A * 11/1994 Rowe ..... 164/234

FOREIGN PATENT DOCUMENTS

JP 59-219410 * 12/1984 ..... 164/132
JP 63-16853 * 1/1988 ..... 164/132

* cited by examiner

*Primary Examiner*—M. Alexandra Elve
*Assistant Examiner*—I.-H. Lin
(74) *Attorney, Agent, or Firm*—Simpson & Simpson, PLLC

(57) ABSTRACT

The removal of bonded sand, either core sand or mold sand, from a metal casting comprises placing the metal casting in a furnace chamber and subjecting the metal casting to the action of a high velocity heated gas stream (preferably above 3000 ft/minute) from hot air generators positioned on opposite sides of the chamber at the approximate level of the metal casting and directed to the metal casting. The heated gas stream is at a temperature and oxygen content sufficient to oxidize the binder in the bonded sand and a velocity sufficient to remove the debonded sand. The sand is removed by gravity from the furnace chamber.

19 Claims, 1 Drawing Sheet

APPARATUS FOR REMOVAL OF SAND FROM METAL CASTINGS

BACKGROUND OF THE INVENTION

1. Field of the Invention

The present invention relates to the field of metal casting and in particular to a method and apparatus for the debinderization and removal of sand from metal castings.

2. Background and Prior Art

The manufacture of metal castings is typically carried out by pouring the molten metal into a sand mold wherein the interior cavity of the mold is suitably shaped to provide the exterior features and shape desired in the casting. Where the molding of interior features in the casting is required, a sand core is employed wherein the interior features of the casting are formed on the external surface of the core. The core and mold are generally made from a mixture of sand and a combustible organic binder which serves to hold the sand grains together and retain the desired shape of the core and/or mold. Following the casting and cooling of the metal part, the sand and binder must be removed from the casting. Sand removal can be accomplished mechanically or thermally.

In the mechanical method, the sand may be removed by physical means, such as shaking or chiseling which may lead to damage or scarring of the casting. If the sand is intended to be recovered for subsequent reuse, it must then be subjected to a heat treatment process to bum off the binder material.

The thermal method involves heating the sand (and casting) to a sufficient temperature to bum off the binder, freeing the sand and allowing it to fall off from the casting. Generally, in this method, heated gases are forced from a heat source to the metal casting, by mechanical circulation, driven, for example, by fans. As commonly practiced, the thermal method, using circulating fans, presents difficulties in that a considerable amount of the falling sand may be picked up in the gas stream and re-circulated thereby resulting in damage to the fans and other components. Furthermore, the rate of sand removal is a function of the rate of heating which, in turn, is a function of the heating capacity of the system and the amount of re-circulating gases. The amount of recirculating gas cannot be easily or conveniently modulated during normal operating conditions, which limits the system flexibility in handling variable loads.

U.S. Pat. No. 4,411,709 to Nakanishi discloses a method for the manufacture of aluminum alloy castings wherein, after casting, a portion of the core sands is mechanically removed and the casting is then heated to a suitable temperature to simultaneously bum out the binder and remove the sand while heat treating the casting.

U.S. Pat. No. 5,294,094 to Crafton et al. disclosed a process wherein the casting with the sand core is passed through a series of furnace units wherein heated air, circulated by fans, is used to heat the casting and bum off the binder. A further airflow is used to dislodge additional sand from the heated casting. The remaining sand may be removed in a subsequent quenching operation.

U.S. Pat. No. 5,354,038 to Crafton discloses a method and apparatus for removing sand core material from a casting and collecting and reclaiming sand. In the reclaiming process the sand is subjected to a fluidization step to aid in the removal of the binder.

U.S. Pat. No. 5,423,370 to Bonnemasou et al discloses a method for sand removal from a metal casting which comprises heating the casting to a temperature sufficient to pyrolyze the binder, in a fluidized bed of solid particles, such as sand.

U.S. Pat. No. 5,439,045 to Crafton discloses a process wherein the sand and residues of the casting material are collected and reclaimed. The process allows for re-use of waste gases from the casting operation.

SUMMARY OF THE INVENTION

It is an object of the present invention to provide an improved method and apparatus for the removal of sand from metal castings, especially light weight metal castings, such as aluminum or aluminum alloy castings.

It is a further object to provide a method and apparatus for the debinderization and removal of sand from metal castings that does not require the use of mechanically operated fans for the circulation of heated air.

The apparatus of the present invention includes a chamber wherein both the metal casting and the heat source are placed. Preferably, the metal casting is placed in a central zone of the chamber for debinderization and sand removal. The heat source comprises at least one hot air generator capable of generating a stream of high velocity heated gas at a temperature and oxygen level sufficient to debinderize the bonded sand. Preferably, two hot air generators are employed, positioned on opposite sides of the chamber at the approximate level of the metal casting(s) and directed to the metal casting(s). Various types of hot air generators may be employed, provided they are capable of generating a high velocity stream of heated gas having a temperature and oxygen content sufficient to combust the binder of the core and/or mold sand associated with the metal casting. Suitable hot air generators include, for example, gas burners, plasma rings, or electric heaters wherein an external blower may be used to force a stream of air through an electrically heated duct. Gas burners may be used, utilizing various fuels, such as, propane, natural gas, liquid fuels, such as oil, or powdered coal in a water slurry, or even solid fuels, such as coal. Preferably, the gas stream produced will have a velocity in the range of about 3000 to 5000 feet per minute. Typically, a gas stream suitable for combustion of the binder will have an oxygen content in the range of about 10 to 20 percent and a temperature in the range of about 700° to 3000° F., depending on the material being treated. In a preferred embodiment of the present invention, the hot air generators are high velocity gas burners having high excess air capability, for example, utilizing an air supply to the burner in an amount of about 100 to 700 percent, preferably about 150 to 300 percent excess of the amount required for complete combustion of the gas supplied.

The apparatus may be used in either a batch or continuous-type operation. Metal castings having core and/or mold sand to be removed may be placed in the chamber individually, or several at a time. Conveniently, the metal casting(s) may be placed in a carrier frame, preferably of open construction to allow sand, loosened from the casting, to pass through and be removed by gravity. For a continuous-type operation, the metal castings may be mechanically transported into the chamber by means of a suitable conveyor, for example, on a monorail. The stream of high velocity hot air not only supplies necessary oxidizing gases and the heat required to raise the temperature of the sand to the level necessary for debinderization, but also provides the necessary circulation of gases for efficient heat transfer and sufficient momentum for dislodging loose sand from the metal casting. As the sand is debinderized, it may be allowed to fall freely from the metal casting, optionally to a collection container below for subsequent treatment and/or reuse.

The chamber in which the debinderization is carried out includes an exhaust means to remove the spent gases in a direction that offers minimal or no interference with the falling sand. The exhaust means is positioned to permit the circulation of the heated gases around the debinderization zone prior to exiting the chamber. The exhaust means preferably includes a screen or grid through which the exhaust gases may pass freely, but which will serve to inhibit the passage of sand and other solid particles therethrough.

The apparatus of the present invention provides an important advantage over the prior art in that the rate of sand removal can be adjusted as a function of part size, amount of sand, and sand characteristics. This can be accomplished easily and cost effectively by varying the amount of heated air generated by the system rather than changing the capacity of re-circulating fans as in the prior art processes.

BRIEF DESCRIPTION OF THE DRAWINGS

The present invention and the manner in which it may be practiced is further illustrated with respect to the accompanying drawing wherein.

DETAILED DESCRIPTION OF THE INVENTION

Figure 1:
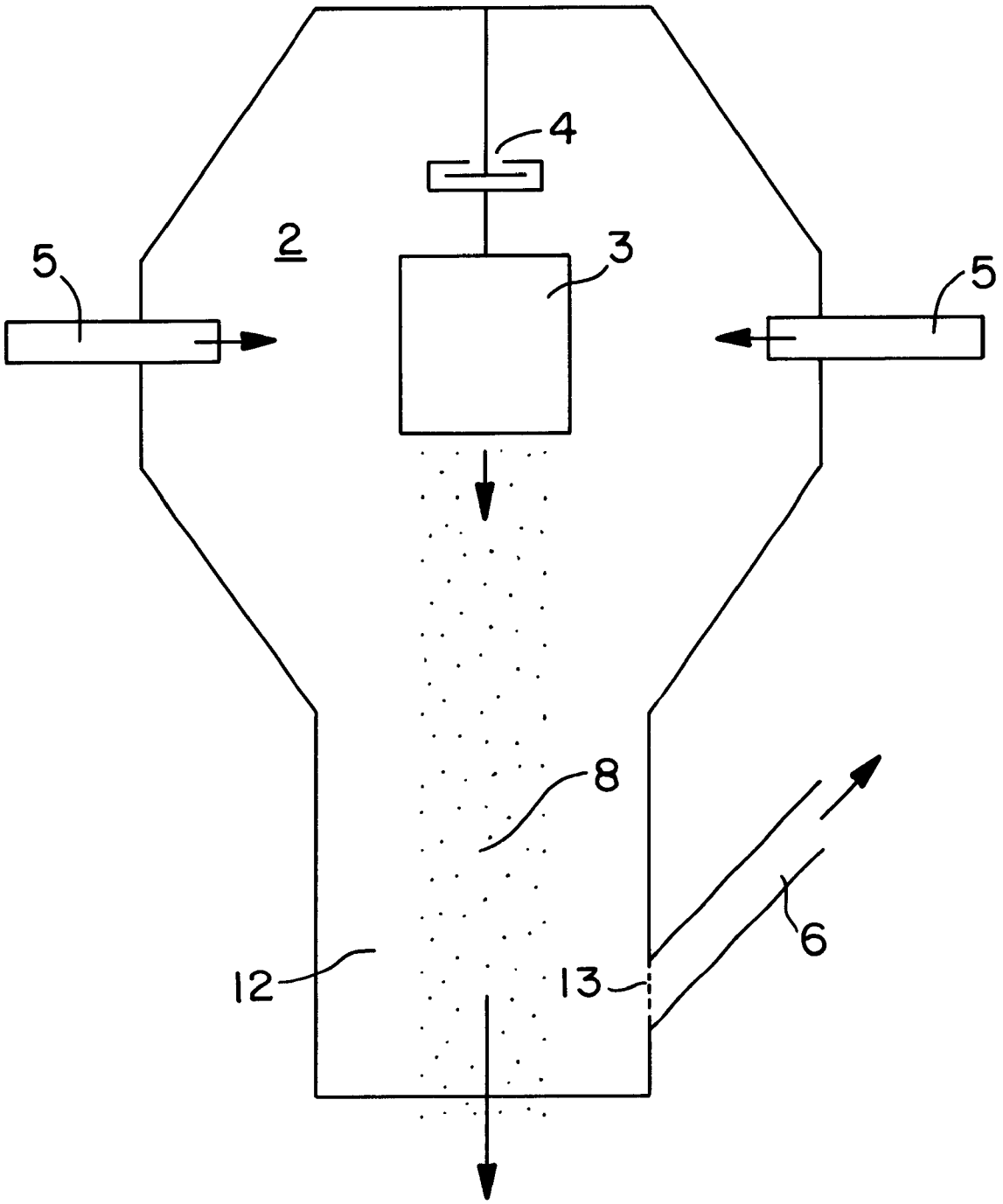
FIG. 1 is a diagrammatic cross-sectional view of the apparatus of the present invention.

The method and apparatus of the present invention are illustrated in FIG. 1 which depicts a sand removal chamber 2 adapted to hold metal castings 3 containing core sand and/or mold sand. Metal castings 3 may comprise a single metal casting or a multiplicity of metal castings contained, for example in a basket or carrier frame (not shown) of open construction to permit the passage of sand therethrough and removal of the sand by gravity. The chamber may be operated in a batch or continuous-type operation. In a continuous-type operation the metal castings may be transported into chamber 2, using roller means, a conveyor chain, or other transport means. Preferably, the metal castings are transported into chamber 2 by means of a monorail 4, as depicted.

Within chamber 2 are one or more hot air generators, such as high velocity burners 5, generating a stream of high velocity heated air at a temperature and oxygen content sufficient to oxidize the binder in the core/mold sand associated with metal casting 3. The oxygen content of the heated air may be conveniently adjusted as needed by adjusting the amount of excess air entering the high velocity burner 5. The spent air stream, after oxidizing the binder, may be exited through a suitable exhaust vent 6, preferably positioned in the lower part of the apparatus, at a level below the metal casting and the hot air generators. The entrance to the exhaust vent may be shielded by a grid 13 that will allow the passage of gases therethrough, but will inhibit the entrance of particles that may be carried in the gas stream. The high velocity stream of heated gas aimed at the metal casting 3, heats to a temperature sufficient to remove the binder by combustion. The high velocity gases then impinge on the loose, debinderized sand and metal casting with sufficient force to remove the loosened sand from the casting, and allow the loose sand particles 8 to move downward by gravity through exit channel 12, optionally to a collection means (not shown) while the spent gases exit through grid 13 and exhaust vent 6.

Although the invention has been described with reference to certain preferred embodiments, it will be appreciated by those skilled in the art, that modifications and variations may be made without departing from the spirit and scope of the invention as defined by the appended claims.

What is claimed is:

1. An apparatus for the removal of bonded sand from a metal casting comprising:

a chamber wherein said metal casting having mold and/or core sand thereon is placed;

input means comprising at least one hot air generator, capable of generating a stream of high velocity heated air, directed to said metal casting, said stream of high velocity heated air having a temperature and oxygen coritent sufficient to oxidize said bonded sand and a velocity sufficient to remove loose sand from said metal casting;

exit channel means for removing debinderized sand falling from said metal casting; and, outlet means for removal of gases from said chamber, said outlet means positioned at a level below said metal casting.

2. An apparatus according to claim 1 wherein said chamber is adapted for placing said metal casting in a generally central zone thereof.

3. An apparatus according to claim 2 wherein said heat source comprises two high velocity hot air generators.

4. An apparatus according to claim 3 wherein said high velocity hot air generators are positioned on opposite sides of said chamber at the approximate level of said metal casting.

5. An apparatus according to claim 4 wherein said hot air generators are high velocity gas burners.

6. An apparatus according to claim 5 including a source of additional air capable of supplying excess air to said high velocity gas burners to increase the oxygen content of said stream of high velocity heated air.

7. An apparatus according to claim 3 wherein said high velocity is at least 3000 feet/minute.

8. An apparatus according to claim 1 wherein said metal casting is an aluminum or aluminum alloy casting having core and/or mold sand adhered thereto.

9. An apparatus according to claim 1 additionally comprising transport means for transporting said metal casting into and out of said chamber.

10. An apparatus according to claim 9 wherein said means for transporting said metal casting is a monorail.

11. An apparatus according to claim 1 wherein said exhaust means comprises an exhaust channel oriented to exhaust said gases from said chamber in a generally upward direction.

12. An apparatus according to claim 11 wherein said exhaust channel includes a grid that allows the generally upward passage of gases through said exhaust channel while inhibiting the passage of sand or other solid particles through said exhaust channel.

13. The apparatus recited in claim 1 wherein said outlet means are oriented to exhaust said gases in a generally upward direction.

14. An apparatus for the removal of core and/or mold sand, comprising sand and a combustible binder, from a metal casting comprising:

a chamber wherein said metal casting having mold and/or core sand thereon may be placed;

at least two high velocity gas burners each capable of generating a stream of high velocity heated gas directed to said metal casting, said stream of high velocity heated gas having a temperature and oxygen content sufficient to oxidize said binder and a velocity sufficient to remove loose sand from said metal casting;

a source of excess air for said high velocity gas burners that provides air in excess of the amount necessary for combustion therein;

an exit channel for the removal of debinderized sand by gravity from said chamber;

an exhaust channel for removal of gas from said chamber, said exhaust channel being positioned at a level below said metal casting and oriented to exhaust said gas in a generally upward direction, said exhaust channel having a grid that allows the generally upward passage of gases through said exhaust channel while inhibiting the passage of sand or other solid particles through said exhaust channel.

15. An apparatus according to claim 14 wherein said source of excess air is capable of providing air to said high velocity gas burners in at least 100 percent excess of the amount required for combustion therein.

16. An apparatus according to claim 15 wherein said chamber is adapted for placing said metal casting in a generally central zone thereof and said high velocity gas burners are positioned on opposite sides of said metal casting at the approximate level thereof.

17. A process for removing core and/or mold sand from metal castings wherein said sand comprises sand grains and a combustible binder, said process comprising:

A) placing said metal casting in a chamber having at least one hot air generator capable of generating a stream of high velocity heated gas having a temperature and oxygen content sufficient to combust said combustible binder agent;

B) generating said stream of high velocity heated gas from said hot air generator;

C) causing said stream of high velocity heated gas to be aimed at said metal casting to heat and debinderize said sand;

D) exhausting gas from said chamber through an exhaust channel in a generally upward direction;

E) allowing heated debinderized sand to fall out of said chamber.

18. A process according to claim 17 utilizing two hot air generators positioned on opposite sides of said chamber producing a stream of high velocity heated gas aimed at said metal casting.

19. A process according to claim 18 wherein said hot air generators are high velocity gas burners.

* * * * *

UNITED STATES PATENT AND TRADEMARK OFFICE

CERTIFICATE OF CORRECTION

PATENT NO. : 6,467,529 B2
DATED : October 22, 2002
INVENTOR(S) : John R. Kay

It is certified that error appears in the above-identified patent and that said Letters Patent is hereby corrected as shown below:

Column 4,
Line 18, replace "coritent" with -- content --

Signed and Sealed this

Twenty-first Day of January, 2003

JAMES E. ROGAN
*Director of the United States Patent and Trademark Office*